US006834728B2

(12) United States Patent
Demole

(10) Patent No.: US 6,834,728 B2
(45) Date of Patent: Dec. 28, 2004

(54) FIRE EXTINGUISHING SYSTEM

(76) Inventor: Frédéric Jean-Pierre Demole, 2 Old Brompton Road, London (GB), SW7 3DQ ( * ) Notice: Subject to any disclaimer, the term of this patent is extended or adjusted under 35 U.S.C. 154(b) by 0 days.

(21) Appl. No.: 10/311,889

(22) PCT Filed: Jun. 22, 2001

(86) PCT No.: PCT/IB01/01102

§ 371 (c)(1),
(2), (4) Date: Dec. 23, 2002

(87) PCT Pub. No.: WO01/97918

PCT Pub. Date: Dec. 27, 2001

(65) Prior Publication Data

US 2003/0094287 A1 May 22, 2003

(30) Foreign Application Priority Data

| | | |
|---|---|---|
| Jun. 23, 2000 | (GB) | 0015541 |
| Jun. 26, 2000 | (GB) | 0015620 |
| Jun. 26, 2000 | (GB) | 0015631 |
| Jul. 4, 2000 | (GB) | 0016279 |
| Jul. 4, 2000 | (GB) | 0016281 |
| Jul. 31, 2000 | (GB) | 0018606 |

(51) Int. Cl.[7] ..... A62C 27/00; E21F 11/00

(52) U.S. Cl. ..... 169/5; 169/54; 169/62; 269/302

(58) Field of Search ..... 169/5, 13, 14, 169/24, 62, 30, 54, 46, 70, 64, 52; 269/71, 67, 69, 302

(56) References Cited

U.S. PATENT DOCUMENTS

| | | | | |
|---|---|---|---|---|
| 6,216,793 B1 * | 4/2001 | Sundholm | ..... | 169/54 |
| 6,415,871 B2 * | 7/2002 | Sundholm | ..... | 169/54 |

FOREIGN PATENT DOCUMENTS

| | | | |
|---|---|---|---|
| JP | 05184693 A * | 7/1993 | ..... A62C/37/00 |
| JP | 10-118211 | 5/1998 | |
| JP | 10-118212 | 5/1998 | |
| JP | 10-179782 | 7/1998 | |
| JP | 10-277173 | 10/1998 | |

OTHER PUBLICATIONS

Patent Abstracts of Japan, vol. 2000, No. 2, Feb. 29, 2000 and JP 11 324598, Nov. 26, 1999.
Patent Abstracts of Japan, vol. 2000, No. 7, Sep. 29, 2000 and JP 2000 116809, Apr. 25, 2000.

* cited by examiner

*Primary Examiner*—Patrick Brinson
(74) *Attorney, Agent, or Firm*—Nixon & Vanderhye, P.C.

(57) ABSTRACT

A system (10) for dousing a fire, such as a tunnel, includes a conduit (11) for delivering a fire extinguishing liquid and a trough (12) extending parallel to the conduit (11) for receiving liquid from the conduit (11). A carriage (27) is arranged to move on a track comprising an upper edge (19) of the trough (12) and the carriage (27) carries a pump having a nozzle (25), a video camera (33) and an inlet (26) each of which can be controlled robotically from a remote control station. The inlet (26) is deployed in the trough (12) to draw liquid from the trough (12). The system avoids complicated docking procedures for the pump.

11 Claims, 4 Drawing Sheets

FIRE EXTINGUISHING SYSTEM

This application is the US national phase of international application PCT/IB01/01102 filed 22 Jun. 2001 which designated the U.S.

This invention relates to a fire extinguishing system.

It is known from JP-100179782-A to provide a system for dousing a fire including a conduit for extending in the space, a track extending in a longitudinal direction of the conduit, pump means adapted to move on the track and adapted to pump liquid delivered to the conduit, drive means adapted to move the pump means along the track, control means for controlling movement of the pump means relative to the track, including video means for viewing from a remote station a scene adjacent the pump means.

A problem with such a known system is that it is necessary to provide docking means whereby the pump means is selectively connectable to the conduit.

It is desirable, therefore, to provide a system for dousing a fire wherein there is no requirement for such docking means.

The present invention is characterised in that there is provided a trough for receiving liquid from the conduit and the pump means include an inlet adapted to enter into liquid transferred from the conduit into the trough.

More particularly, the invention relates to a system for dousing a fire including a conduit for extending in the space and for delivering a fire extinguishing liquid to the space, a track extending in a longitudinal direction of the conduit, pump means adapted to move on the track and adapted to pump liquid delivered to the conduit, drive means adapted to move the pump means along the track, control means for controlling movement of the pump means relative to the track characterised in that there is provided a trough for receiving liquid from the conduit and the pump means includes an inlet adapted to enter into liquid transferred from the conduit into the trough.

In various preferred embodiments of the invention:

the trough includes a plurality of walls forming a series of compartments.

there is provided a plurality of connecting members for communicating the conduit with the trough, each connecting members being associated with a corresponding one of the compartments.

each of the connecting members is provided with a valve for controlling flow of liquid from the conduit to the trough.

each of the compartments is provided with sensing means for sensing whether level of liquid in the corresponding compartment is at a predetermined level.

each sensing means is adapted to control operation of a corresponding valve.

the inlet is adapted to move from an inoperative position clear of the trough to an operative position entering into the liquid in the trough.

the inlet adapted to enter into liquid is fixed.

video means are included in the controlling means and a video camera is mounted on the pump means.

the track is located on a side of the trough.

the drive means is electrically operated and includes a shoe adapted to engage a conductor rail located on the trough.

the video means is linked with a remote control station by electromagnetic radiation at least on part of the way.

the nozzle is movable in order to direct the jet of water or foam onto the fire and in that the control means are used to move the nozzle.

it comprises a source of light for lighting the scene.

it comprises an arm affixed to the pump means and extending in different directions than the track, the nozzle of the pump means being movable among the arm.

Following is a description, by way of example only and with reference to the accompanying drawings, of one method of carrying the invention into effect.

DESCRIPTION OF A PREFERRED EMBODIMENT

Figure 1:
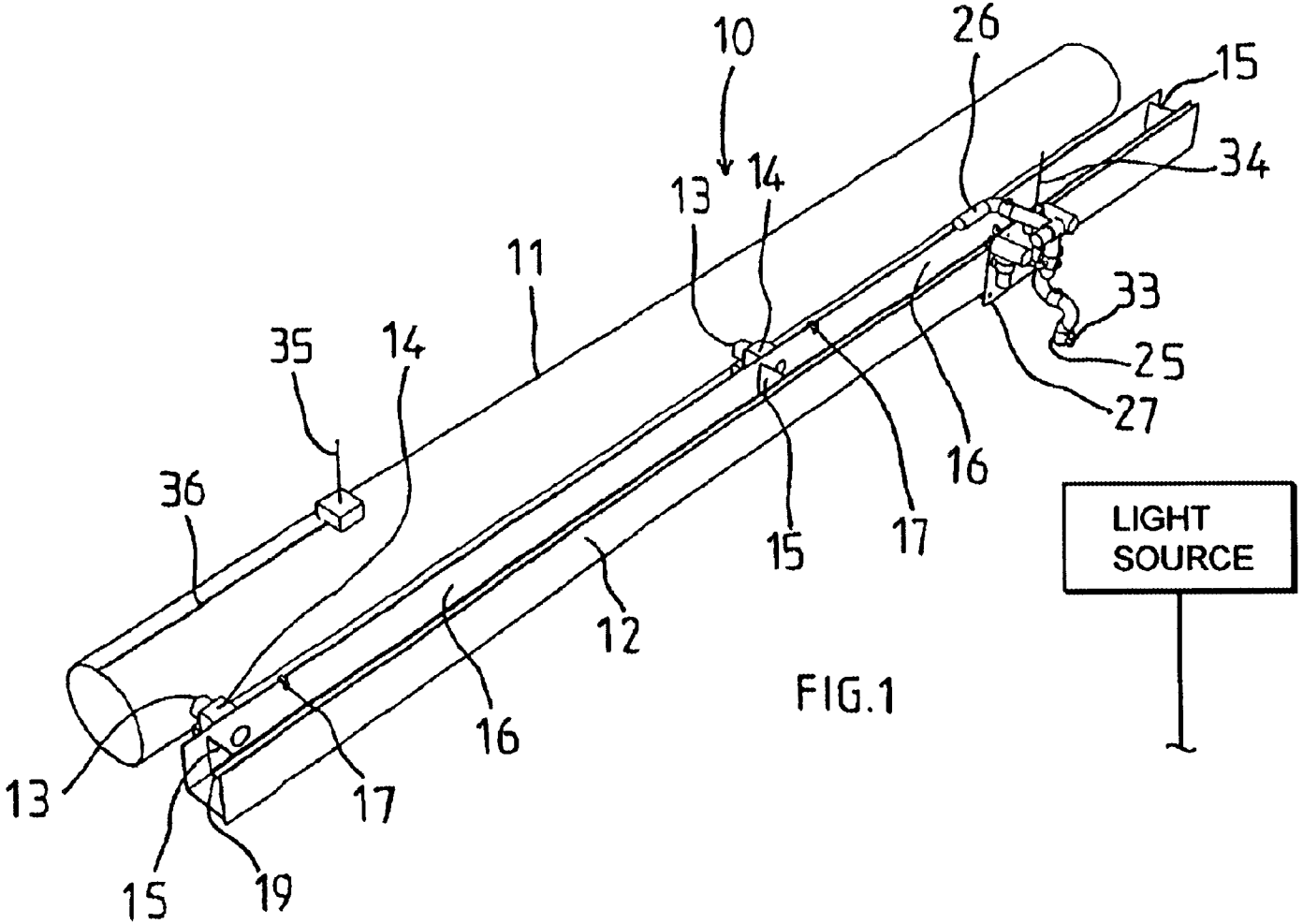
FIG. 1 is a diagrammatic representation of one embodiment of a system for dousing a fire in accordance with the present invention, the system shown in an inoperative condition.

Referring now to the drawings, there is shown a system 10 for dousing a fire in a tunnel. The system 10 comprises a conduit 11 extending longitudinally of the tunnel and an elongate trough 12, open from above, which extends parallel to the conduit 11 and is attached thereto by a series of spaced parallel hollow connectors 13 each having located therein a valve 14. Each of the connectors 13 communicates the interior of the conduit 11 with the interior of the trough 12. The trough 12 is provided with a plurality of longitudinally spaced walls 15 which divide the trough 12 into a series of compartments 16 each associated with a corresponding one of the connectors 13. The trough 12 is also provided with a plurality of sensors 17 for detecting the level of a liquid 18 contained in an associated compartment 16. Sensor 17 data is used to control the corresponding valve 14 connected to that compartment 16 in which the pump means pumping liquid 18 in such a way that if the liquid 18 in a compartment 16 rises to a predetermined level, the corresponding valve 14 is closed.

The trough 12 is provided with an elongate upper edge 19 and a track 20 extending longitudinally and downwardly of the trough 12. The trough 12 is also provided with an inwardly extending flange 21 on which a series of posts 22 formed of electrically non-conductive material are mounted which support a conductor rail 23 of electrically conductive material.

The upper edge 19 of the trough 12 and the track 20 carry an electrically controlled pump 24 having a nozzle 25 and an inlet 26, the pump 24 being mounted on a carriage 27 having spaced pairs of wheels 28, 29 adapted to engage respectively the upper edge 19 of the trough 12 and the track 20. The carriage 27 is provided with a shoe 30 for engaging the conductor rail 23. The carriage 27 is also provided with electrically operated motors 31, 32 for driving the upper wheels 28, current for the motors 31,32 being collected from the conductor rail 23 via the shoe 30.

Figure 2:
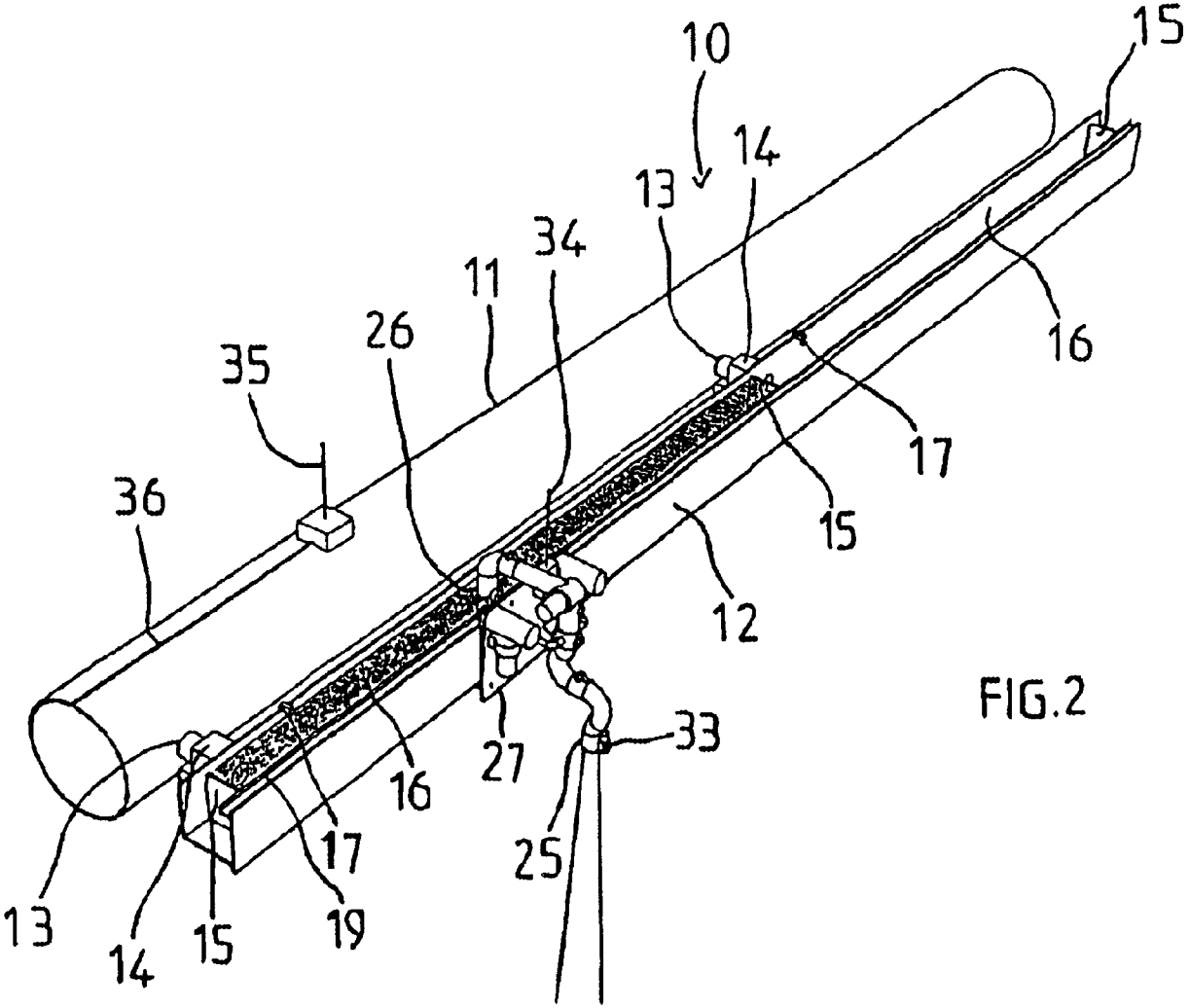
FIG. 2 is a view corresponding to FIG. 1, showing the system in an operative condition.
Figure 3:
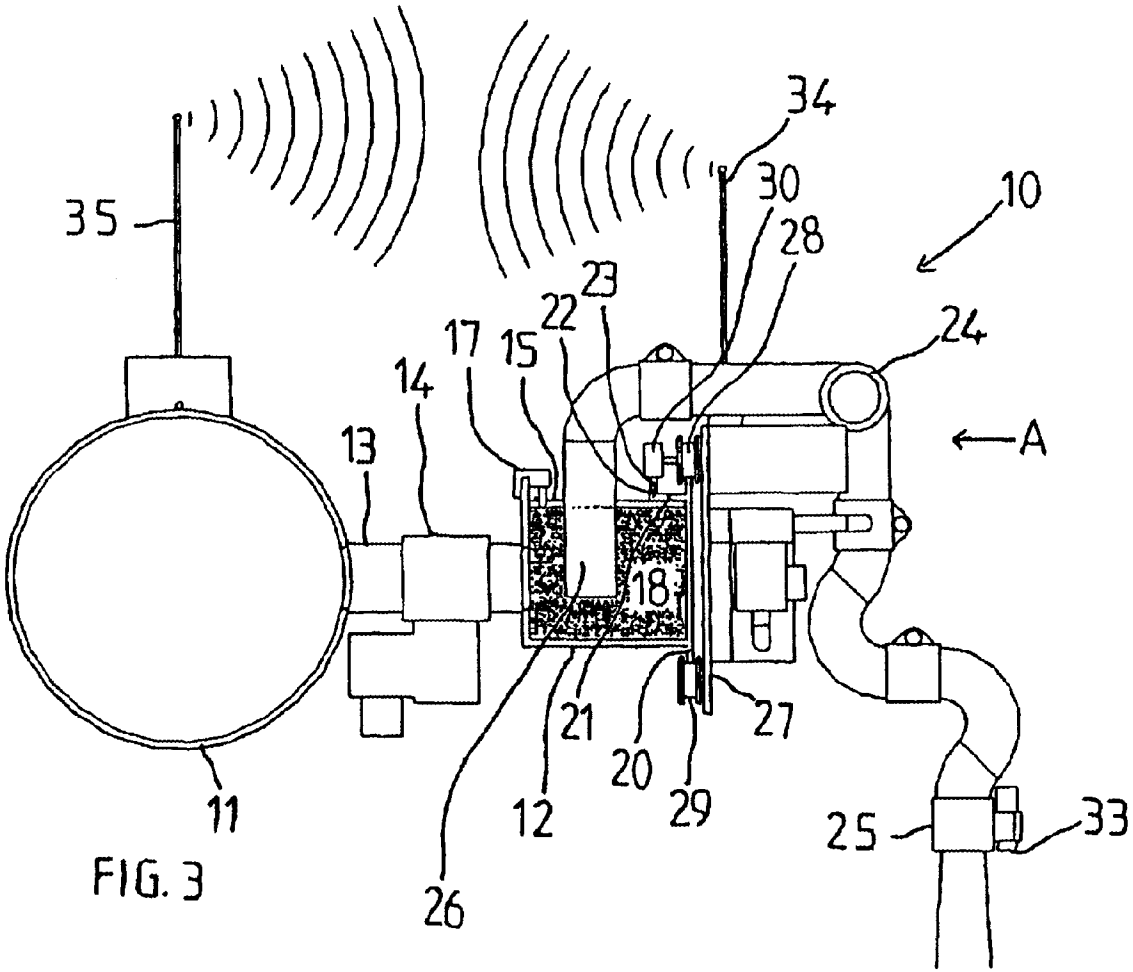
FIG. 3 is a diagrammatic cross section of apparatus included in the system shown in FIGS. 1 and 2, when in an operative condition.
Figure 4:
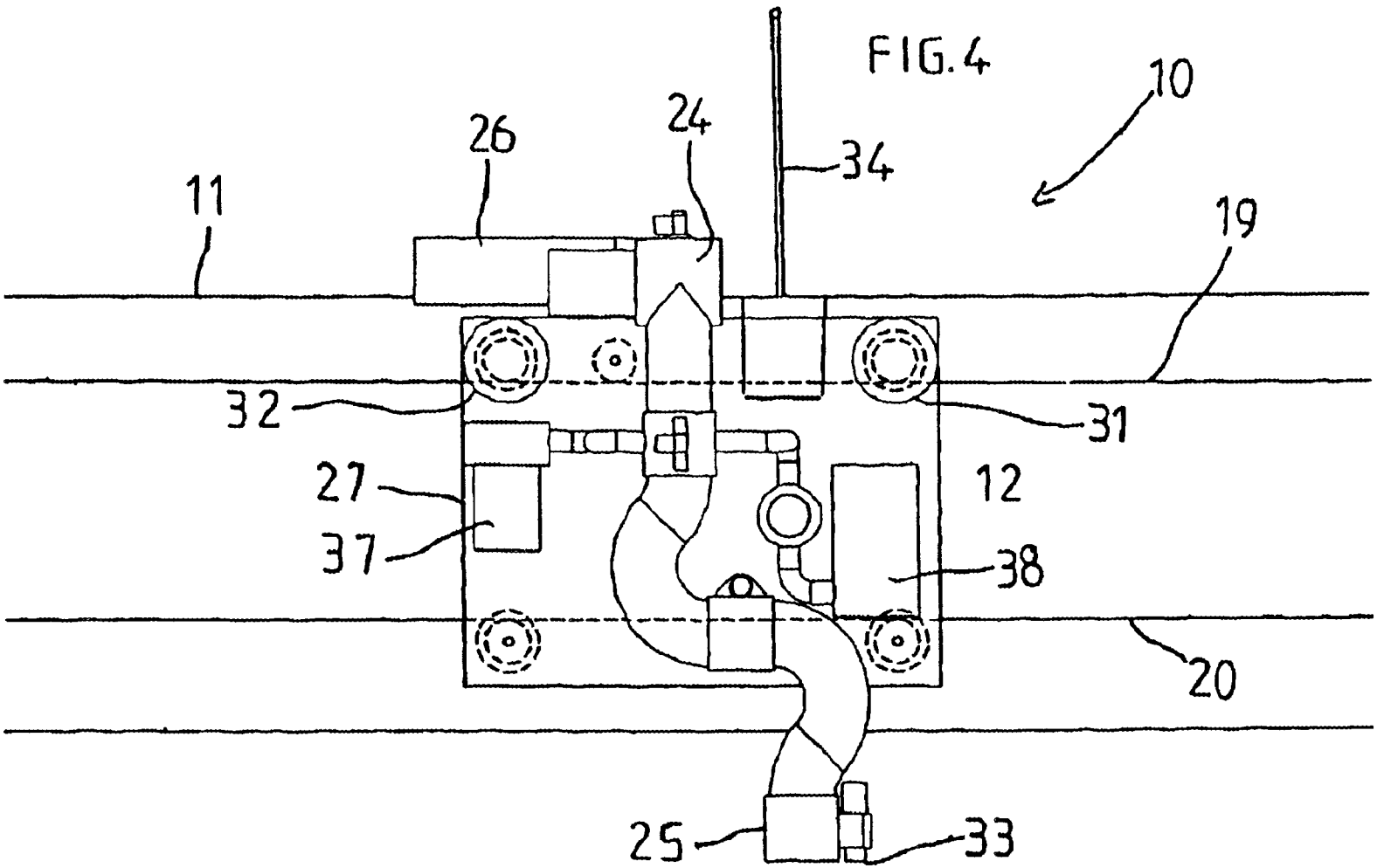
FIG. 4 is a view in the direction of the arrow <<A>> of FIG. 3, when in an inoperative condition.

The inlet 26 is controlled so as to move from an inoperative condition, as shown in FIGS. 1 and 4 in which the inlet 26 is positioned so as not to extend into the trough 12, to an operative condition, as shown in FIGS. 2 and 3 in which the inlet 26 extends into the trough 12.

The nozzle 25 carries a video camera 33 and the carriage 27 is provided with an antenna 34 whereby signals from the video camera 33 are transmitted by electromagnetic radiation to a remote antenna 35 connected to a remote control station by a fibre optic 36. The control signals of the electromechanical devices are also transmitted by the fibre optic 36.

The pump 24 is connected to an air compressor 37 and a container 38 containing a foaming agent.

The arrangement is such that fire extinguishing liquid in the form of water or foam is pumped into the conduit 11 and, in the event of a fire occurring in the tunnel, the carriage 27 is propelled longitudinally of the trough 12 under control of signals communicated via the antenna 34, 35, the scene generated by signals received from the video camera 33 being monitored at the remote control station. At the same time, the appropriate valve 14 is then operated so that the water or foam flows under pressure through the corresponding connector 13 and into a corresponding compartment 16 of the trough 12.

When the fire is observed on a screen at the remote control station, the carriage 27 is positioned to be as close to the fire as is possible and the carriage 27 is braked on the trough 12 at that location. The inlet 26 is then deployed so that a free end portion thereof extends into the water or foam that has been delivered into the compartment 16 and the pump 24 is operated so as to provide a jet of the water or foam in a direction towards the fire.

DESCRIPTION OF A SECOND EMBODIMENT

If the trough 12 is not divided in compartments (for example if the trough 12 has a small length of only a few meters), it is not necessary to provide the system with a movable inlet 26. In that case, the inlet 26 may be fixed.

It will be appreciated that, with a system for dousing a fire in accordance with the present invention, there is no requirement to provide docking means for connecting the pump 24 to the supply of water or foam.

It will also be appreciated that the fire fighting or security personal may be equipped with a two-way radio that is relayed to the remote control station by the relay 35 and the fibre optic 36 so that this personal is able to communicate with the remote station. The carriage 27 may also be provided with a microphone and a loudspeaker so that voices and sound near the pump means can be monitored and that announcements may be made at the location of the fire from the remote control station.

DESCRIPTION OF A THIRD EMBODIMENT

According to a variant of the invention, an arm extends from the pump means 24 in a different direction than the track 20.

The outlet 25 of the pump means is movable along this arm in order to be as close to the location of the fire as possible.

DESCRIPTION OF A FOURTH EMBODIMENT

According to a variant of the third embodiment, a second track is provided at some distance of the system and a carriage is provided that moves on that track and that end of the arm that is not affixed to the pump means lays on that carriage.

What is claimed is:

1. A fire extinguishing system for dousing a fire including a conduit for extending in a space and for delivering a fire extinguishing liquid to the space, a track extending in a longitudinal direction of the conduit, pump means adapted to move on the track and adapted to pump liquid delivered to the conduit, drive means adapted to move the pump means along the track, control means for controlling movement of the pump means relative to the track characterized in that there is provided a trough for receiving liquid from the conduit, the trough is provided with a plurality of walls forming a series of compartments in the trough, at least one of the compartments is provided with a connecting member for communicating a compartment with the conduit, at least one of the connecting members is provided with a valve for controlling the flow of liquid from the conduit to a compartment and the pump means is provided with an inlet that can either be moved to an inoperative position such that the pump means is able to move unobstructed from a compartment to another compartment and so on until it is near a compartment that is close to the fire, or that it can be moved to an operative position entering the liquid that has been transferred from the conduit in the compartment close to the fire such that the pump means can pump the liquid from that compartment and douse the fire.

2. A fire extinguishing system as claimed in claim 1 characterized in that each of the compartments is provided with sensing means for sensing whether level of liquid in the corresponding compartment is at a predetermined level.

3. A fire extinguishing system as claimed in claim 1 characterized in that the control means includes video means and a video camera mounted on the pump means.

4. A fire extinguishing system as claimed in claim 1 characterized in that the track is located on one side of the trough.

5. A fire extinguishing system as claimed in claim 1 characterized in that the drive means is electrically operated and includes a shoe adapted to engage a conductor rail.

6. A fire extinguishing system as claimed in claim 1 characterized in that the pump means is linked with a remote control station by electromagnetic radiation.

7. A fire extinguishing system as claimed in claim 1 characterized in that a nozzle connected to the pump means is movable in order to direct a jet of water or foam onto the fire.

8. A fire extinguishing system as claimed in claim 1 characterized in that there is provided a source of light for lighting the space.

9. A fire extinguishing system as claimed in claim 1 characterized in that the inlet adapted to enter into the liquid is fixed.

10. A fire extinguishing system as claimed in claim 1 characterized in that there is provided an arm affixed to the pump means and extending in different directions than the track, the nozzle of the pump means being movable along the arm.

11. A fire extinguishing system as in claim 10 characterized in that there is provided a second track and a carriage is provided that moves on that track and that end of the arm that is not affixed to the pump means lays on that carriage.

* * * * *